US006439135B1

(12) United States Patent
Pope

(10) Patent No.: US 6,439,135 B1
(45) **Date of Patent: *Aug. 27, 2002**

(54) ORGANIC WASTE GASIFICATION PROCESSING AND THE PRODUCTION OF ALTERNATIVE ENERGY SOURCES

(75) Inventor: G. Michael Pope, Danville, KY (US)

(73) Assignee: International Environmental Technologies, Inc., Danville, KY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/977,760

(22) Filed: Nov. 25, 1997

(51) Int. Cl.[7] ..... F23G 5/16; F23N 5/18; F23N 5/04; F23N 5/24

(52) U.S. Cl. ..... 110/233; 110/296; 110/214; 110/229; 110/235; 110/211; 110/186; 110/191; 48/197 FM

(58) Field of Search ..... 110/229, 233, 110/341, 346, 235, 208, 210, 211, 214, 295, 296, 185, 186, 191; 431/2, 5; 60/39.12; 123/3; 48/113, 197 FM

(56) References Cited

U.S. PATENT DOCUMENTS

| | | | | | |
|---|---|---|---|---|---|
| 624,388 | A | * | 5/1899 | Siemens | 110/229 |
| 685,539 | A | * | 10/1901 | Swindell | 110/229 |
| 2,808,012 | A | * | 10/1957 | Schindler | 100/296 X |
| 4,378,745 | A | * | 4/1983 | Flatland | 110/214 X |
| 4,398,475 | A | * | 8/1983 | McKiel, Jr. | 110/210 X |
| 4,941,415 | A | | 7/1990 | Pope et al. | 110/235 |
| 5,159,899 | A | * | 11/1992 | Dobrzynski | 110/229 X |
| 5,222,446 | A | * | 6/1993 | Edwards et al. | 110/211 X |
| 5,279,234 | A | * | 1/1994 | Bender et al. | 110/214 X |
| 5,313,894 | A | * | 5/1994 | Ishikawa | 110/210 X |
| 5,569,312 | A | * | 10/1996 | Quirk et al. | 110/210 X |
| 5,573,568 | A | * | 11/1996 | Quirk et al. | 110/210 X |
| 5,619,938 | A | * | 4/1997 | Kaneko | 110/229 X |
| 5,711,232 | A | * | 1/1998 | Yamaguro et al. | 431/2 X |
| 5,741,465 | A | * | 4/1998 | Gregg | |
| 5,823,122 | A | * | 10/1998 | Chronowski et al. | 110/229 X |
| 5,881,654 | A | * | 3/1999 | Fleming et al. | 110/296 X |

FOREIGN PATENT DOCUMENTS

| | | | | |
|---|---|---|---|---|
| DE | 24 32 504 | * | 1/1976 | |
| DE | 26 39 165 | * | 3/1978 | 110/233 |
| DE | 40 30 743 A1 | * | 4/1992 | |
| EP | 0 173 628 A2 | * | 3/1986 | 110/210 |
| WO | 93/08242 | * | 4/1993 | |

* cited by examiner

*Primary Examiner*—Ljiljana Ciric
(74) *Attorney, Agent, or Firm*—Fish & Richardson, PC, PA

(57) ABSTRACT

A municipal waste gasification system comprises a plurality of primary gasification chambers for receiving municipal waste, a means for operating the municipal waste gasification system so that one or more of the primary gasification chambers may be idle while the other primary gasification chambers are operating to produce an effluent by an oxygen-starved process, a means for heating the municipal waste under oxygen-starved conditions in the primary gasification chambers in order to gasify the municipal waste and produce the effluent, and at least one mixing chamber positioned to receive the effluent produced by the primary gasification chambers with an effluent pathway extending through each mixing chamber. The invention also includes a means for supplying an oxygen-containing gas to the effluent in the mixing chamber in order to produce a mixed effluent, a secondary combustion chamber positioned to receive the mixed effluent produced by the mixing chamber, and a means for incinerating the mixed effluent in the secondary combustion chamber.

9 Claims, 8 Drawing Sheets

ORGANIC WASTE GASIFICATION PROCESSING AND THE PRODUCTION OF ALTERNATIVE ENERGY SOURCES

FIELD OF THE INVENTION

The invention relates to organic waste gasification processing using an oxygen-starved ($O_2$-starved) gasification process, and is also directed toward deriving alternative energy sources from by-products produced by such a process.

BACKGROUND OF THE INVENTION

Current municipal and other waste production is increasing in volume and is expected to continue increasing. Increased reliance is being placed on waste disposal methods that eliminate waste without requiring the use of scarce landfill space. One such disposal method that is known and widely used is a "mass burn" waste incinerator.

Another disposal method that is known gasifies the organic waste without burning it. An example of such a method is disclosed in the present inventor's U.S. Pat. No. 4,941,415, which is incorporated by reference. With the waste gasification method, organic waste is first converted into a gaseous effluent by heating the waste at a high temperature and in an $O_2$-starved chamber. The resulting $O_2$-deficient effluent is released from the chamber and then mixed with an $O_2$-containing gas so that the effluent can be combusted to provide a cleaner emission into the atmosphere. The $O_2$-enriched effluent is combusted using a flame burner, and the resulting exhaust is released into the atmosphere through a stack.

A way that the $O_2$-deficient effluent has been mixed with the $O_2$-containing gas in the past, which is disclosed in the '415 Patent, uses a hollow ring that surrounds the path of effluent flow and introduces the $O_2$-containing gas into the path at a single cross-section. The effluent, now $O_2$-enriched, flows upward where a set of flame burners direct a "roped" flame upward into an inverted ceramic cup. The ceramic cup provides a high temperature environment for combustion. The ceramic cup also slows the effluent's flow to achieve a more complete combustion.

For waste disposal methods that avoid the use of landfill space but which produce emissions into the atmosphere, there is a need to provide systems that produce cleaner emissions. There is also a need to provide for waste disposal system designs that minimize building costs while meeting the individual needs of the waste producer (for example, producers with different volumes of waste and space requirements). Further yet, there is also a need to provide alternative fuel sources.

SUMMARY OF THE INVENTION

In one aspect, the invention provides for an alternative energy source that is derived from an $O_2$-starved effluent produced when organic waste is subjected to an $O_2$-starved gasification process. The energy source is used to power a variety of secondary applications.

In one embodiment, the $O_2$-deficient effluent serves as the energy source that could be used, for example, in a combustion engine. This energy source could be stored in a transportable tank prior to being used, so that the secondary application could be located at a remote site. In another embodiment, the $O_2$-deficient effluent is mixed with an $O_2$-containing gas, and the mixed effluent serves as the energy source that could be used, for example, in a machine that produces steam, in a reverse-refrigeration process, or in a grain dryer. In another embodiment, mixed (that is, $O_2$-enriched) effluent is combusted to produce heat that serves as the energy source that could be used, for example, in a hot-water heater or to smelt aluminum.

In another aspect, the invention is an organic waste gasification processor whose emissions into the atmosphere are cleaner. This gasification processor has a primary gasification chamber for receiving waste and for producing an effluent by an $O_2$-starved process. The gasification processor also has a mixing chamber with an effluent pathway extending therethrough. The mixing chamber receives the effluent produced by the primary gasification chamber and mixes it with an $O_2$-containing gas. The $O_2$-containing gas is introduced into the effluent pathway at a plurality of entry points positioned along most of the length of the portion of the effluent pathway that extends through the mixing chamber. The length over which the $O_2$-containing gas is introduced into the pathway may be, for example, about eight feet in length. Finally, a secondary combustion chamber receives and incinerates the mixed effluent.

In one embodiment, the mixing chamber has an inner jacket that surrounds the effluent pathway. The inner jacket has a plurality of holes arranged in a scattered array that serve as the entry points into the effluent pathway. An outer jacket surrounds the inner jacket and forms a gas gap between the two jackets. The $O_2$containing gas to be introduced into the mixing chamber is first received in the gas gap. The $O_2$-containing gas then flows through induction tubes that extend through the holes in the inner jacket and into the effluent pathway. Pillowed insulation on an inside surface of the inner jacket, which protects the jackets of the mixing chamber from excessive heat, additionally creates turbulence in, and hence reduces the flow rate of, the effluent passing through the mixing chamber.

With the entry points of the $O_2$-containing gas spread over an increased length of an effluent pathway, improved mixing of the effluent with an $O_2$-containing gas occurs that what was possible with the prior art (for example, the design disclosed in the '415 Patent). Also, the manner by which the $O_2$-containing gas is introduced into the effluent pathway and the irregular surface of the effluent pathway at the point of mixing, both add turbulence into, and slow, the effluent flow, thereby enhancing the effluent mixing process. This is achieved without the need for the ceramic cup used in the prior design disclosed in the '415 Patent to slow effluent flow. One or more of increasing the retention time within the effluent pathway, increasing the mixing length, and increasing the distance between the point of mixing and final effluent combustion provides a more thorough combustion of the mixed effluent.

In yet another aspect, the invention is an expandable waste gasification system that combines multiple $O_2$-starved primary gasification chambers in a waste gasification system. The system has a single secondary combustion chamber and one or more mixing chambers that mix(es) the effluent produced by the multiple primary chambers with an $O_2$-containing gas. The expandable nature of the multiple primary gasification chamber design enables a gasification system design to be easily tailored to an individual or community's needs. As such, the cost of building systems that meet a waste producer's individual needs is minimized.

Advantages of the invention include one or more of the following. Virtually complete elimination or reuse of solid and liquid wastes is achieved. From the wastes that are initially loaded, the system produces recyclable glass, aluminum, other metals, and a fine, inert ash, as well as the combustible gas. The gas may be combusted in a manner that provides for a cleaner emission into the atmosphere, or it may be used to derive an alternative energy source. The latter conserves traditional energy sources that would otherwise be used to power a secondary application. As a result, an attractive and environmentally friendly alternative to disposing waste in landfills and "mass burn" incinerators is provided. Additional advantages of the invention will be apparent from the following description and claims.

DETAIL DESCRIPTION OF THE INVENTION

Figure 1:
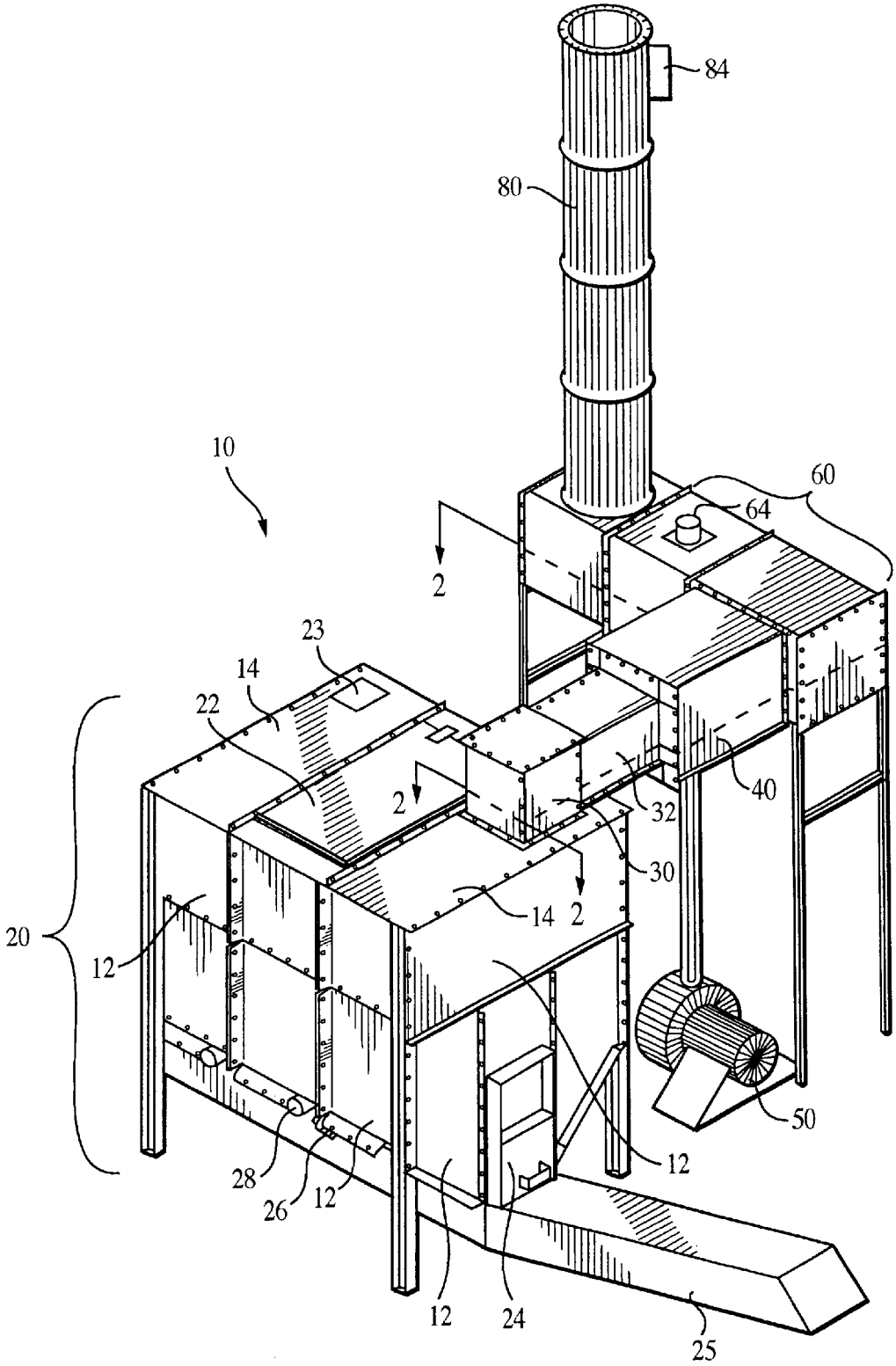
FIG. 1 is a perspective view of an $O_2$-starved gasification waste gasification processor incorporating aspects of the invention.

An embodiment of an $O_2$-starved waste gasification processor 10 incorporating aspects of the invention is shown in FIG. 1. Briefly, the gasification processor converts solid waste placed in a primary gasification chamber (PGC) 20 into a gaseous effluent. The effluent exits the PGC 20 and travels through an $O_2$-mixing chamber 40. $O_2$-enriched effluent from the mixing chamber 40 enters a secondary combustion chamber 60 for final combustion. Exhaust from the final combustion is released into the atmosphere through an exhaust stack 80.

In more detail, the incineration process proceeds as follows. Municipal or other solid waste is batch loaded into the PGC 20 through an access door 22. Typically, the PGC 20 is about 20 feet wide×20 feet tall×33 feet long. The PGC 20 can hold approximately 20 tons of municipal solid waste, based on an average weight of 125 pounds per cubic yard of solid waste. The interior surfaces of the floor (hidden from view), walls 12, and top 14 of the PGC 20, as well as the access door 22, are of panel steel fabrication lined with one inch ceramic fiber board and six inches of standard refractory brick lining. The loaded waste rests upon a cast iron grate (hidden from view) inside the PGC 20. As combustible waste is converted into the gaseous effluent, the resulting ash falls through the grate and onto a conveyor, an external portion of which is shown as 25.

After loading, the access door 22 is hydraulically, manually or pneumatically closed. When closed, the access door's weight seals the door 22 against a ceramic gasket (hidden from view) to prevent gases from escaping during waste gasification and prevents air from entering the PGC 20. All other openings, such as a clean-out door 24 and a butterfly damper 28, are also closed.

Next, one or more heaters 26 (partially hidden from view) raise the internal temperature of the now-loaded PGC 20 to a temperature sufficient to convert the waste to a gaseous effluent. Typically, waste converts to a gaseous effluent at about 750° F. The heater 26 could be, for example, one or more burners of propane gas, natural gas, or diesel fuel. The heater 26 could also be, for example, one or more electric infrared heat rods. The number of heaters needed to effectively raise the PGC 20 temperature to about 750° F. is a function of the overall PGC 20 dimensions. Typically, there are two heaters.

While the PGC 20 heats the waste, the butterfly damper 28 regulates the amount of air entering the PGC 20. The butterfly damper 28 is adjusted to maintain the $O_2$concentration inside the PGC 20 at less than about 7%. The $O_2$ concentration within the PGC 20 is monitored using continuous $O_2$ sensors (not shown). The temperature (750° F.) and depleted $O_2$ content of the PGC 20 cause the waste within the PGC 20 to slowly convert from solids, sludges and liquids to a virtually smoke-free and particulate-free gaseous effluent without catching "on fire". As a result, an $O_2$-starved or smoldering process is achieved. To guard against accidental explosions, a spring-loaded gate or tension membrane 23 on top of the PGC 20 releases to reduce the pressure within the PGC 20 should the pressure suddenly increase due to an occasional rapid combustion of materials in the waste load.

Gaseous effluent produced by the $O_2$-starved process proceeds along an effluent pathway that will be described in more detail below. Briefly, however, the gaseous effluent exits the PGC 20 and flows into a gas accumulation chamber 30. From there, the effluent travels through a transfer tube 32 and into the mixing chamber 40 where the effluent becomes $O_2$-enriched with an $O_2$-containing gas, such as ambient air. A gas supply device 50 introduces the $O_2$-containing gas into the mixing chamber 40. The term "$O_2$-enriched effluent" as used herein refers to a gaseous effluent produced by an $O_2$-starved process that has had its $O_2$ content elevated above the $O_2$ concentration of the effluent produced by the PGC 20. $O_2$-enriched effluent is combustible.

$O_2$-enriched effluent exiting the mixing chamber 40 enters the secondary combustion chamber 60 where flame burners 64 combust the $O_2$-enriched effluent. Exhaust from this secondary incineration exits the gasification processor 10 by passing through the exhaust stack 80. The stack 80 is triple-walled stainless steel and has an air sampling port 84 to facilitate measuring the effectiveness of the incineration process. Typically, incineration effectiveness is determined by monitoring carbon monoxide (CO), nitrous oxides ($NO_x$), sulfur dioxide ($SO_2$), hydrochloric acid (HCl), carbon dioxide ($CO_2$) and water vapor ($H_2O$) in the stack according the United States Environmental Protection Agency (EPA) guidelines or other relevant environmental guidelines, e.g., Code of Federal Regulations part 40, sub-part 60. The most prevalent gases leaving the stack 80 are carbon dioxide and water vapor.

The entire incineration process for a waste load of 2–200 tons typically takes 10–12 hours, after which time the gasification processor 10 is shut down. Following a cooling period of approximately four hours, the PGC 20 may be reloaded with waste. Fine ash and non-combustibles that accumulate in the PGC 20 are removed by opening the clean-out door 24 and activating the exit conveyor 25. Typically, it is necessary to remove the accumulated fine ash and non-combustibles every 6 to 10 cycles.

Figure 2:
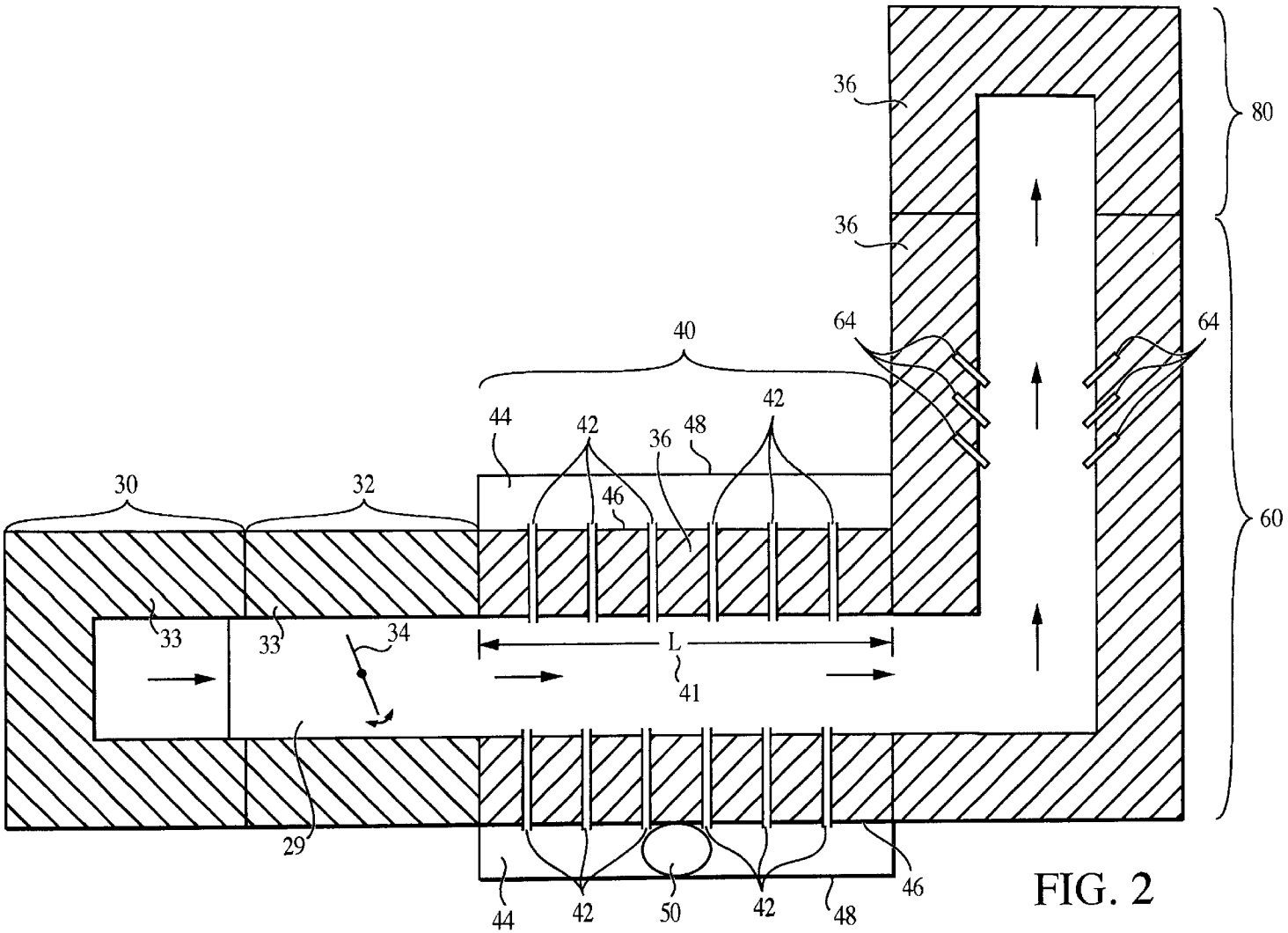
FIG. 2 is a cross-sectional view of an effluent pathway in the gasification processor along line 2—2 of FIG. 1.

FIG. 2 shows a cross-section, viewed from above, of the effluent pathway 29 mentioned above from the PGC 20 to the stack 80 of FIG. 1. Except for the mixing chamber 40 and the secondary combustion chamber 60, which each have different protective linings, the effluent pathway 29 has a protective lining 33 that includes 1 inch ceramic fiber board and 6 inches of standard refractory brick lining. A stainless steel damper 34 regulates the amount of effluent exiting the gas accumulation chamber 30 and entering the mixing chamber 40. The temperature and the $O_2$ concentration within the gas accumulation chamber 30 are maintained by adjusting both the butterfly damper 28 (FIG. 1) and the damper 34 in conjunction with the heater 26 (FIG. 1).

In the mixing chamber 40, an outer jacket 48 and an inner jacket 46 form a gas gap 44 therebetween. The inner jacket 46 is 6 to 10 feet in length (dimension "l" of FIG. 2). The gas supply device 50 introduces the $O_2$ containing gas into the gas gap 44, which pressurizes the gas gap 44. The gas supply device 50 pressurizes the gas gap 44 typically by using ambient air delivered by pulse pressure at about 8–15 psi.

The pressure created in the gas gap 44 forces the $O_2$-containing gas through a plurality (typically numbering 32, though only 12 are shown in FIG. 2) of gas-induction tubes 42 that extend from the gas gap 44, through the inner jacket 46 and ceramic fiber insulation 36, and into the effluent pathway 29. The gas induction tubes 42 are each one inch in diameter. The plurality of gas induction tubes 42 are positioned in a random scattered configuration on all four sides of the inner jacket 46 along most of the length of the inner jacket 46 (dimension "l" of FIG. 2).

The tubes 42 are thus positioned along most of the length of that portion of the effluent pathway 29 extending through the mixing chamber 40. In other words, the tubes 42 are positioned length-wise over more than a single cross-section of effluent pathway 29. The length-wise positioning provides continuous mixing of the effluent as it proceeds through the mixing chamber 40. In addition, the $O_2$-containing gas entering the pathway 29 through the tubes 42 creates turbulence in the effluent passing through the mixing chamber 40. This turbulence increases retention time of the effluent in the mixing chamber 40 and further contributes to mixing efficiency.

The flame burners 64, also shown in FIG. 2, may be positioned about 8 feet from the mixing chamber 40, which allows for $O_2$-enriched effluent to continue to mix prior to final combustion. The flame burners 64 typically use ambient air as a propellent and function as a pilot light by exposing the $O_2$-enriched effluent to a live flame, thereby combusting the effluent. The combustion of the $O_2$-enriched effluent maintains the secondary combustion chamber 60 at about 2300° F. The number of flame burners 64 depends on both the type and volume of waste materials processed. In addition, the flame burners 64 may be oriented at varying angles of deflection to continue to mix and create additional turbulence. Typically, the flame burners 64 are oriented at an angle of about 45 degrees against the effluent flow, as is shown in FIG. 2.

Figure 3:
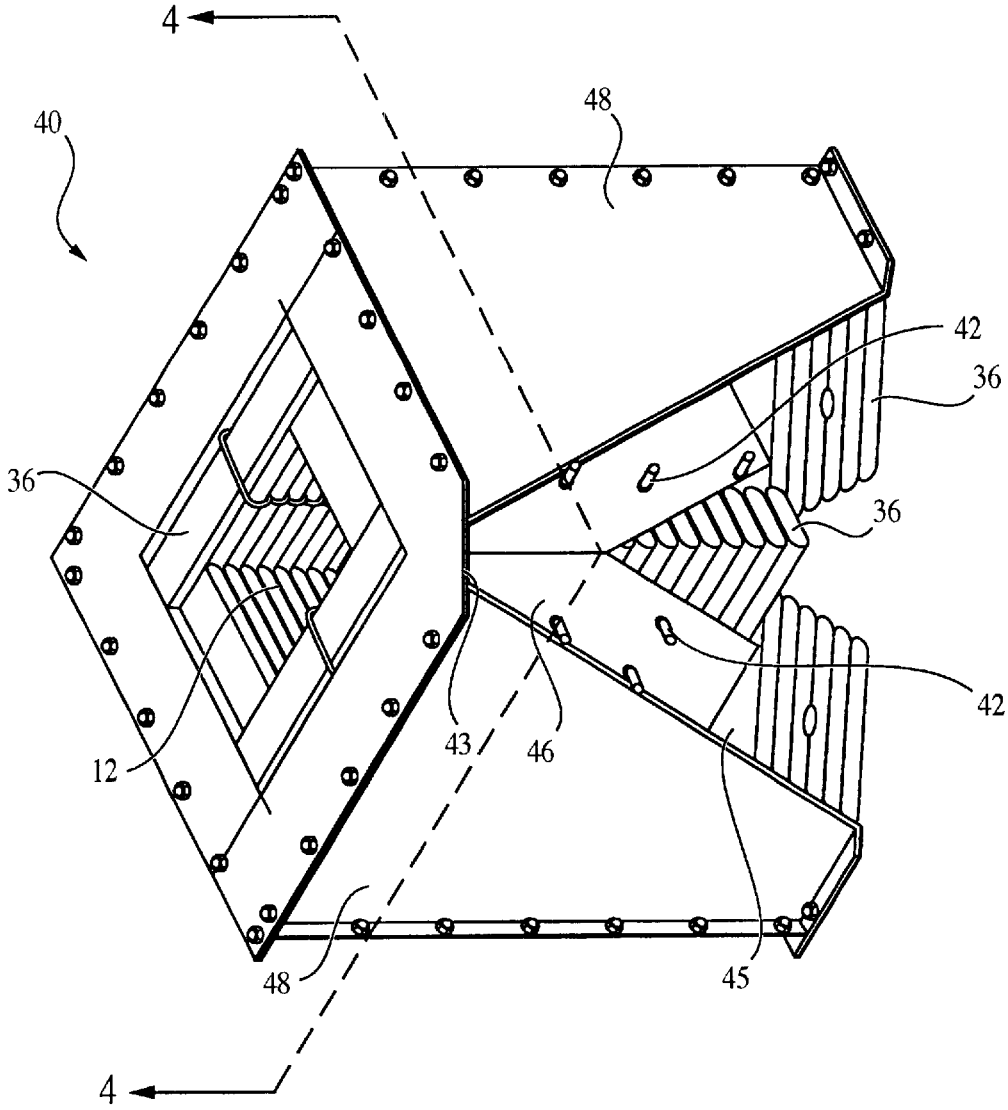
FIG. 3 is a perspective view, with a portion cut away, of a mixing chamber in the gasification processor of FIG. 1.
Figure 4:
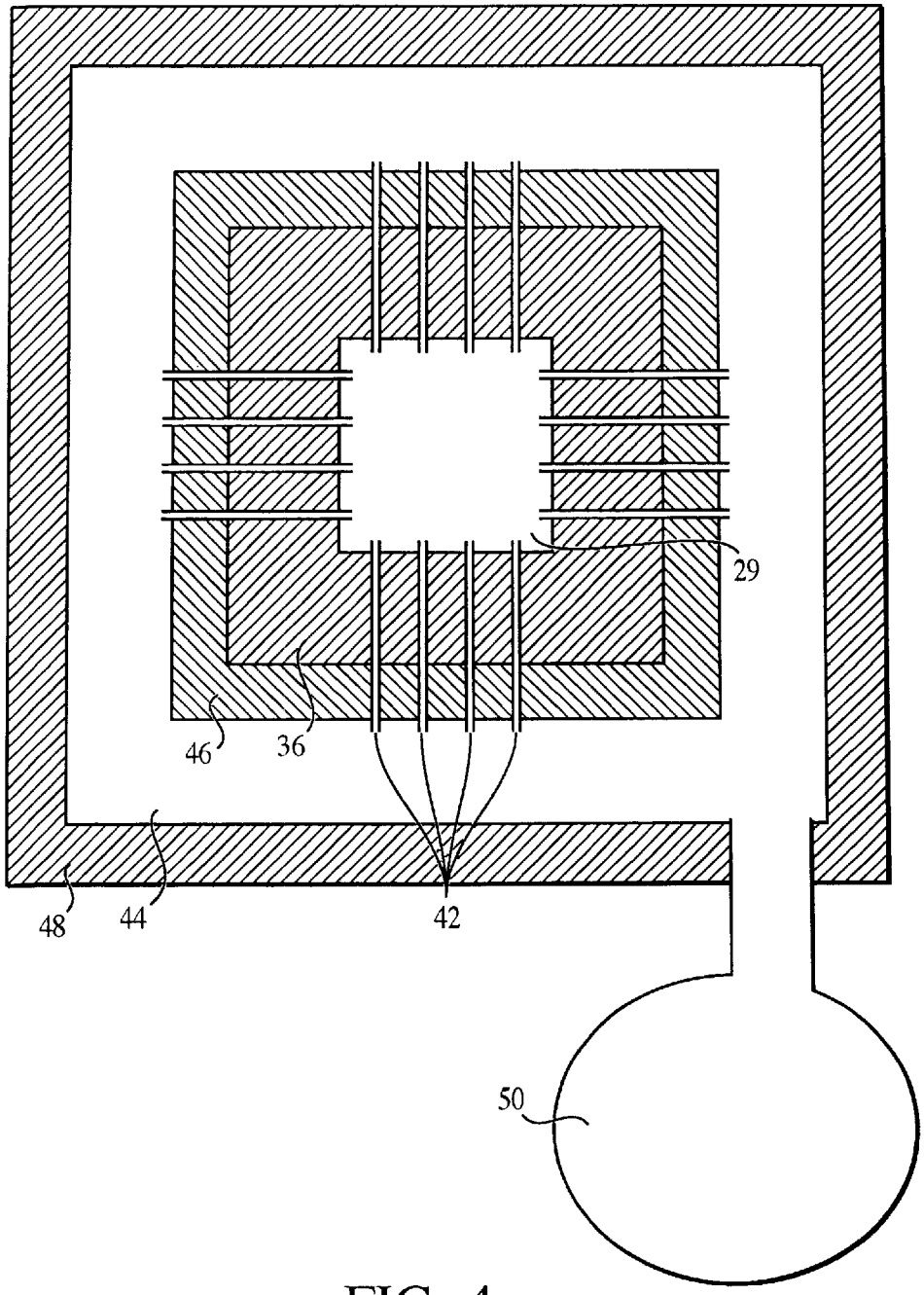
FIG. 4 is an cross-sectional view of the mixing chamber along line 4—4 of FIG. 3.

FIGS. 3 and 4 illustrated the construction of the mixing chamber 40 in more detail. The inner and outer jackets 46 and 48 may be made of hot-rolled A36 sheet steel. The two jackets 46 and 48 are configured, in essence, as a box within a box, as can be best seen from the cross-sectional view of FIG. 4. The jackets 46 and 48, together with end walls 43 and 45 (see FIGS. 2 and 3), bound the gas gap 44.

Referring to FIG. 3, ceramic fiber insulation 36 of a "pillowed" manufacture and is bolted to the inner surface of the inner jacket 46. The pillows of the insulation 36 are a conventional spun ceramic fiber insulation product. The pillows are rectangular in shape and arranged in a herringbone pattern. The herringbone pattern protects the underlying metal of the inner jacket 46 by providing a seamless insulation surface. The insulation 36 provides an irregular surface surrounding the effluent pathway 29. The irregular surface causes further turbulence with the passing effluent and increases the retention time of the effluent, which contributes to the mixing efficiency.

A gasification processor constructed as set forth in FIGS. 1–4 has been found to achieve an improved secondary combustion. Computer models suggest that the secondary combustion chamber 60 incinerates 99.9% of the mixed effluent's combustible organic material. The prior design discussed in the background above, which design introduced all of the $O_2$-containing gas into the effluent at a single point and nearer to the point of the secondary combustion, did not mix the effluent with $O_2$-containing gas as well, and thereby did not incinerate as efficiently. With the entry points of the $O_2$-containing gas spread over an increased length of the effluent pathway 29, improved mixing is achieved. In addition, the increased turbulence created by the mixing chamber 40 slows the effluent's flow, which further improves mixing and also allows more time for the mixed effluent to combust. This slowing is achieved without the need for the ceramic cup used in the prior design. As a result of the increased mixing efficiency, a flammable $O_2$-enriched effluent is produced.

Although the current configuration has the gas induction tubes 42 extending from the inner jacket 46 into the effluent pathway 29, other designs may also facilitate effective effluent mixing while still incorporating the invention. For example, the gas induction tubes 42 may be shortened so that they end within the ceramic insulation 36. The $O_2$-containing gas would then proceed through gaps between individual pillows of the ceramic insulation 36 and into the effluent pathway 29. Also, the ends of the gas induction tubes 42 near the effluent pathway 29 may be altered to change the gas stream exiting the gas induction tubes 42. Further yet, the gas induction tubes 42 may be eliminated altogether whereby the $O_2$-containing gas would enter the ceramic insulation 36 via holes in the inner jacket 46, and proceed through gaps between the pillows of the ceramic insulation 36 until the $O_2$-containing gas enters the effluent pathway 29.

Figure 5:
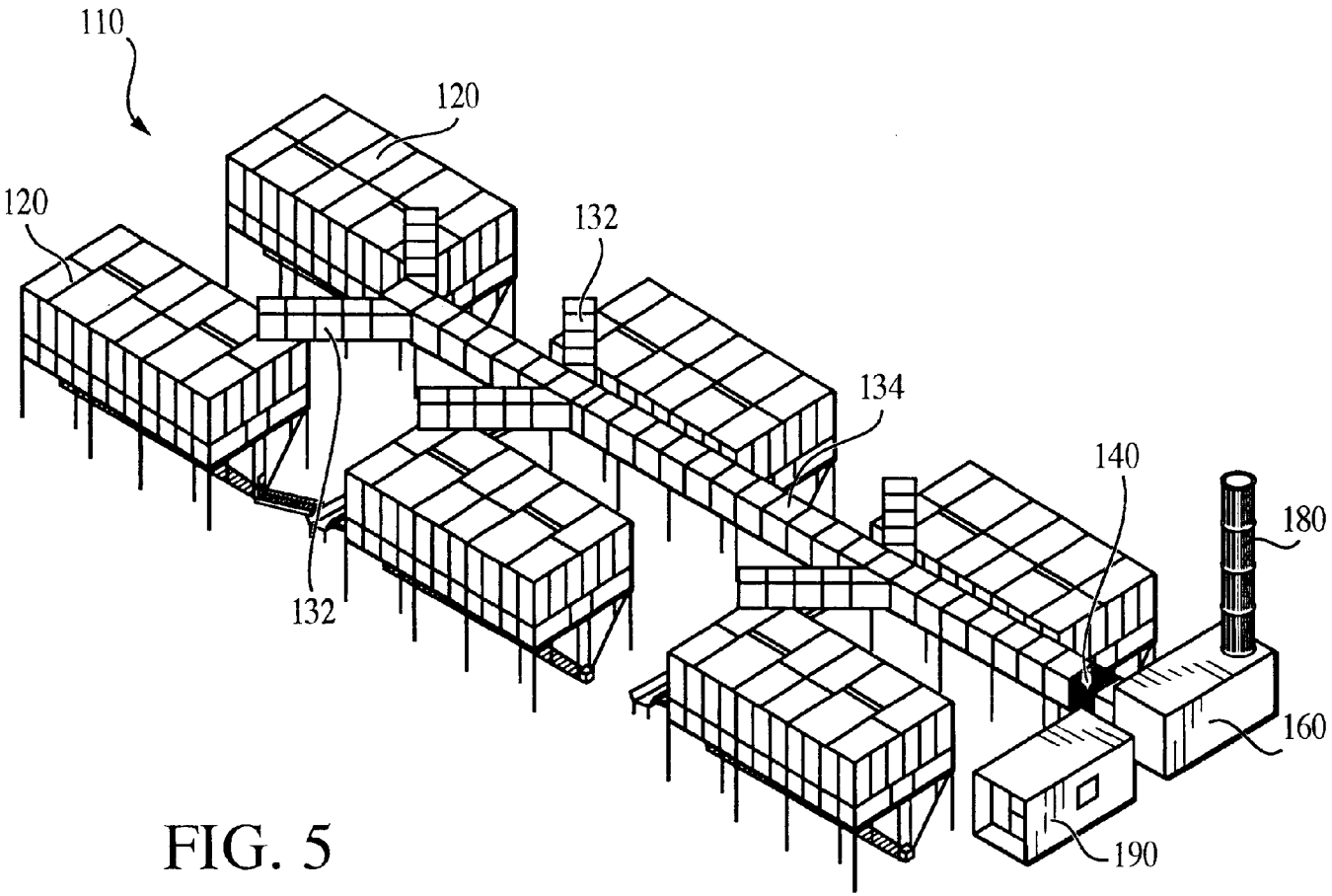
FIG. 5 is a perspective view of an $O_2$-starved gasification waste gasification system incorporating aspects of the invention.

In another aspect of the invention, features of the municipal waste gasification processor 10 of FIG. 1 are adapted to construct an expandable waste gasification system 110, shown in FIG. 5. Expandable waste gasification system 110 is designed to accommodate the waste disposal needs of an individual client and may be modified to accommodate 500 pounds to 3000 tons of solid waste per day by altering the size of the individual PGC 120 or modifying the number of PGCs 120.

The waste gasification system 110 illustrated in FIG. 5 has six 20-ton-capacity PGCs 120 that are arranged to discharge their gaseous effluent through transfer tubes 132 and into a common effluent duct 134. The common effluent duct 134 is connected to a common mixing chamber 140, which is connected to a single secondary combustion chamber 160. The system 110 may be operated so that each day, one PGC 120 is idle to receive incoming waste. The idle PGC 120 provides additional system capacity to accommodate peak waste collection periods and to provide an extra PGC 120 in the event another PGC 120 must be shut down for maintenance.

Figure 7:
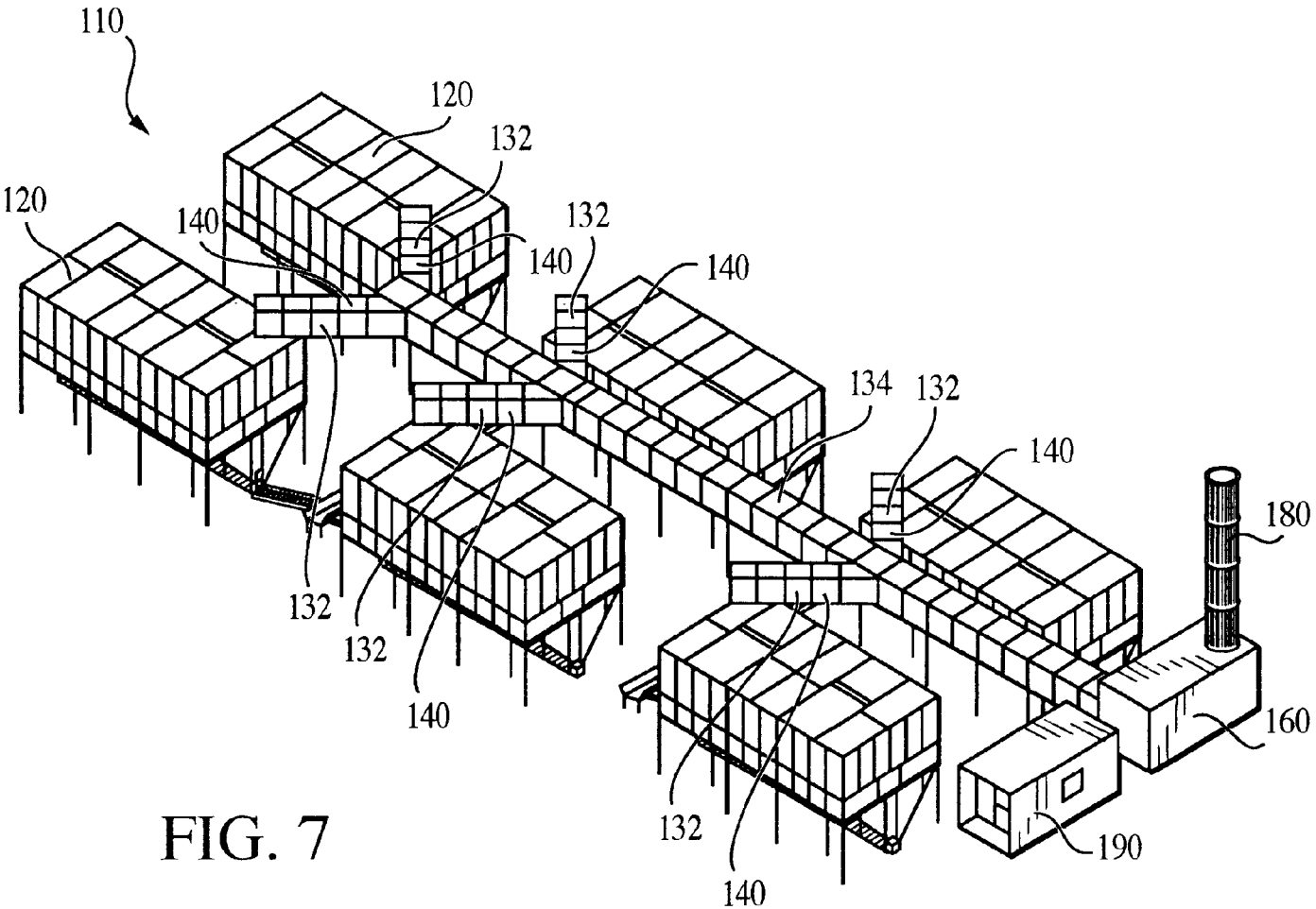
FIG. 7 is a perspective view of a further embodiment of the waste gasification system shown in FIG. 5.
Figure 8:
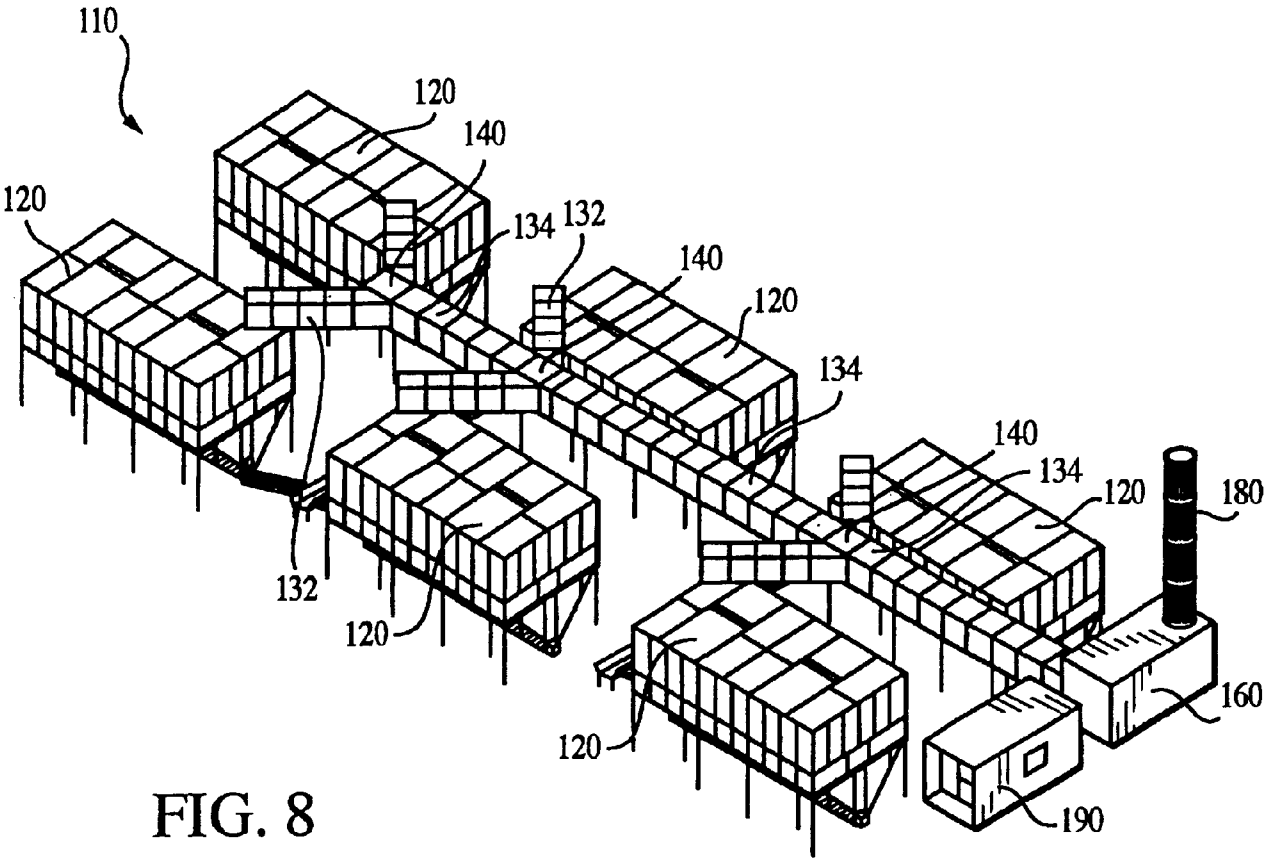
FIG. 8 is a perspective view of another embodiment of the waste gasification system shown in FIG. 5.

The mixing chamber 140 is of the design discussed above and facilitates the production of $O_2$-enriched effluent prior to final combustion in the single secondary combustion chamber 160 and release into the atmosphere through exhaust stack 180. Although FIG. 5 shows a single mixing chamber 140 positioned adjacent to the single secondary combustion chamber 160, alternative positioning of the mixing chamber 140 is possible. For example, one or more mixing chambers 140 could be positioned at other positions along the effluent duct 134. For example, six mixing chambers 140 could be used, with each positioned between each transfer tube 132 and the common effluent duct 134 (as shown in FIG. 7), or three mixing chambers 140 could be used, with each positioned between pairs of transfer tubes 132 along the common effluent duct 134 (as shown in FIG. 8).

The waste gasification processor 10 (FIG. 1) or expandable waste gasification system 110 (FIG. 5) may be controlled manually or by varying degrees of automation. For example, the waste gasification processor 10 or expandable waste gasification system 110 could be equipped with conventional remote control sensors and controllers. Remote control from a central processing center 190 (FIG. 5) or computer using conventional computer programs may facilitate such control. Elements of the waste gasification processor 10 that are typically remotely controlled or monitored include the PGC 20 temperature, PGC 20 heating, PGC 20 $O_2$ concentration, effluent $O_2$ concentration, access door 20, clean-out door 24, conveyor 25, butterfly damper 28, stainless steel damper 34, gas gap 44 internal pressure, secondary combustion chamber 60, and stack 80 emissions.

In another aspect of the invention, the municipal waste gasification processor 10 of FIG. 1 or the expandable waste gasification system 110 of FIG. 5 is used as a source of energy. The $O_2$-deficient gaseous effluent produced by a PGC 20 or 120 can serve as a low-grade combustible gaseous fuel source for a variety of secondary applications. Also, the heat produced by the secondary combustion chamber 60 or 160 can serve as a heat source for a variety of other secondary applications.

Figure 6:
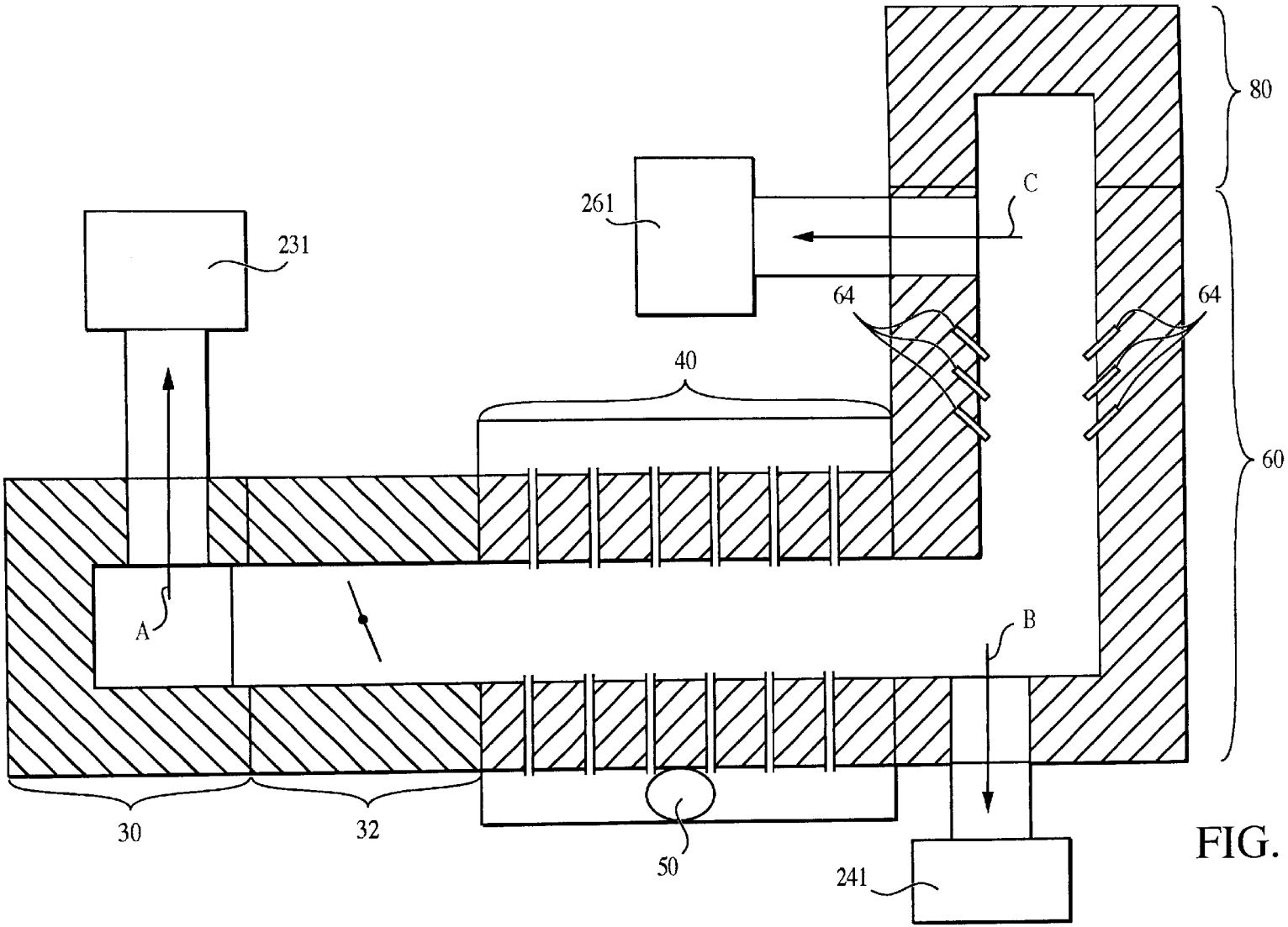
FIG. 6 is the effluent pathway of FIG. 2, showing alternative uses for effluent in accordance with an aspect of the invention.

As shown in FIG. 6, an effluent pathway of the type shown in FIG. 2 is fitted with a conventional diverter to divert, as shown by arrow A, the $O_2$-deficient effluent produced by a PGC 20 before the effluent reaches the mixing chamber 40. The effluent may be diverted to a conventional collection tank 231. Then, the effluent may be loaded into transportable tanks so that the effluent may be transported to where it is used as a low-grade fuel source. An example of a machine that could be adapted to use the effluent as a fuel source is a combustion engine. In this case, mixing of the $O_2$-deficient effluent with an $O_2$-containing gas occurs during the engine's carburetion process. The machine, alternatively, could be on site, in which case there may be no need for the collection tank 231 or the transportable tanks.

Still referring to FIG. 6, the effluent pathway also could be fitted with a conventional diverter for diverting, as shown by arrow B, the $O_2$-enriched effluent exiting the mixing chamber 40, so that this effluent can be used in a secondary application 241. The secondary application 241 could be, for example, a burner or boiler for producing 60-, 90- or 120-pound steam, a grain dryer, or other conventional burners that use a low-grade flammable fuel source. Another possibility is that the tanked $O_2$-deficient effluent discussed above could be transported to, and channeled into, a mixing chamber at a remote site, thus providing an $O_2$ enriched effluent for a remote secondary application. In this case, it is preferable, though not absolutely necessary, to bottle and transport the $O_2$-deficient effluent, instead of the $O_2$-enriched effluent, because the $O_2$-deficient effluent is less flammable and is smaller in volume.

Referring still to FIG. 6, heat generated by the secondary combustion chamber 60 could be used as a heat source for a variety of applications. To do so, the effluent pathway is fitted with a conventional diverter to divert the heat as shown by arrow C. The heat could be used, for example, to heat water for industrial or commercial purposes, or to smelt aluminum, or the heat could be used in any process requiring heat within the ranges produced by the secondary combustion chamber 60.

Other embodiments are within the scope of the following claims.

What is claimed is:

1. A municipal waste gasification system comprising:

a plurality of primary gasification chambers for receiving municipal waste and for producing an effluent by an oxygen-starved process;

a means for operating the municipal waste gasification system so that one or more of the plurality of primary gasification chambers may be idle while other primary gasification chambers of plurality of primary gasification chambers are operating to produce the effluent by the oxygen-starved process;

means for heating the municipal waste under oxygen-starved conditions in the plurality of primary gasification chambers in order to gasify the municipal waste and produce the effluent;

at least one mixing chamber, positioned to receive the effluent produced by the plurality of primary gasification chambers, each mixing chamber having an effluent pathway therethrough;

means for supplying an oxygen-containing gas to the effluent in the at least one mixing chamber in order to produce a mixed effluent;

a single secondary combustion chamber, positioned to receive the mixed effluent produced by the at least one mixing chamber; and means for incinerating the mixed effluent in the secondary combustion chamber.

2. The municipal waste gasification system of claim 1 wherein the at least one mixing chamber comprises a single mixing chamber positioned adjacent to the secondary combustion chamber.

3. The municipal waste gasification system of claim 1 wherein the at least one mixing chamber comprises a plurality of mixing chambers corresponding in number to the plurality of primary gasification chambers, each mixing chamber positioned to receive effluent produced by one primary gasification chamber.

4. The municipal waste gasification system of claim 1 wherein the at least one mixing chamber comprises a plurality of mixing chambers corresponding in number to one half the plurality of primary gasification chambers, each mixing chamber positioned to receive effluent produced by two primary gasification chambers.

5. The municipal waste gasification system of claim 1 wherein the means for supplying the oxygen-containing gas comprises a plurality of entry points that introduce the oxygen-containing gas into the mixing chamber, the plurality of entry points positioned length-wise over more than a single cross-section of the effluent pathway that extends through the mixing chamber, and wherein the length of a portion of the effluent pathway extending through the mixing chamber is at least eight feet.

6. The municipal waste gasification system of claim 1 wherein the number of primary gasification chambers is at least six.

7. A municipal waste gasification system comprising:

a plurality of primary gasification chambers for receiving municipal waste and for producing an effluent by an oxygen-starved process;

a means for operating the municipal waste gasification system so that one or more of the plurality of primary gasification chambers may be idle while other primary gasification chambers of plurality of primary gasification chambers are operating to produce the effluent by the oxygen-starved process;

means for heating the municipal waste under oxygen-starved conditions in the plurality of primary gasification chambers in order to gasify the municipal waste and produce the effluent;

a plurality of transfer tubes, positioned to receive the effluent produced by the plurality of primary gasification chambers, for receiving the effluent from the primary gasification chambers, there being one transfer tube for each gasification chamber;

a common effluent duct, connected to the plurality of transfer tubes, for receiving the effluent from the transfer tubes;

a mixing chamber, connected to the common effluent duct, for receiving the effluent from the common effluent duct;

means for supplying an oxygen-containing gas to the effluent in the mixing chamber in order to produce a mixed effluent;

a single secondary combustion chamber, positioned to receive the mixed effluent produced by the mixing chamber;

means for incinerating the mixed effluent in the secondary combustion chamber; and a stack, positioned to receive waste gases exiting the secondary combustion chamber, for releasing waste gases exiting the secondary combustion chamber.

8. The municipal waste gasification system of claim 7 comprising at least six of the primary gasification chambers.

9. The municipal waste gasification system of claim 7 wherein the means for supplying the oxygen-containing gas comprises a plurality of entry points that introduce the oxygen-containing gas into the mixing chamber, the plurality of entry points positioned lengthwise over more than a single cross-section of the effluent pathway that extends through the mixing chamber, and wherein the length of a portion of the effluent pathway extending through the mixing chamber is at least eight feet.

* * * * *